US007338307B2

(12) United States Patent
Zhang et al.

(10) Patent No.: US 7,338,307 B2
(45) Date of Patent: Mar. 4, 2008

(54) ELECTRICAL CONNECTOR

(75) Inventors: Guo-Hui Zhang, Kunshan (CN); Kui Xie, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/604,621

(22) Filed: Nov. 27, 2006

(65) Prior Publication Data

US 2007/0123087 A1 May 31, 2007

(30) Foreign Application Priority Data

Nov. 26, 2005 (CN) ..... 2005 2 0078041

(51) Int. Cl.
*H01R 13/62* (2006.01)

(52) U.S. Cl. ..... 439/326; 439/541.5

(58) Field of Classification Search ..... 439/326, 439/631, 632, 634, 635, 636, 637, 541.5
See application file for complete search history.

(56) References Cited

U.S. PATENT DOCUMENTS 5,232,379 A 8/1993 Lai
5,567,171 A 10/1996 Mizuguchi
6,095,827 A * 8/2000 Dutkowsky et al. ..... 439/83
6,454,574 B1 * 9/2002 Yu ..... 439/79
6,575,763 B1 6/2003 Choy
6,726,499 B1 4/2004 Yu
6,764,338 B2 7/2004 Fang
2004/0029438 A1 * 2/2004 Choy ..... 439/541.5

* cited by examiner

*Primary Examiner*—Ross Gushi
(74) *Attorney, Agent, or Firm*—Wei Te Chung

(57) ABSTRACT

An electrical connector for connecting electrically an electronic card to a printed circuit board includes an insulative housing (10) and at least one piece of lower terminal (12) comprising a mating portion (121), the mating portion receiving in a bottom wall (131) and extending into a mating slot (135), a rising portion (125) which extending from the back-end of said mating portion upwardly, a main portion (122) extending rearwardly from a top end of said rising portion and a mounting portion (124) extending downwardly from the back-end of said main portion.

18 Claims, 14 Drawing Sheets

ELECTRICAL CONNECTOR

BACKGROUND

1. Field of the Invention

The invention relates to an electrical connector, and particularly to an electrical connector having a reduced height above a printed circuit board.

2. The Related Art

U.S. Pat. No. 5,232,379 discloses an electrical connector comprising an insulative body and two rows of terminals. The two rows of terminals have mating portions, retaining portions and mounting portions, wherein one of said two rows of terminals have bending portions at the retaining portions for adjusting the space between two neighbouring mounting portions. Because the bending portions are positioned at the outside of the insulative body, it is difficult to decrease the width of the connector in the direction along which said mating portions extend. U.S. Pat. No. 5,567,171 discloses an electrical connector comprising an insulative body and two rows of terminals. Each terminal has a mating portion, a retaining portion and a mounting portion, wherein the mounting portions of said two rows of terminals extend to the same side of said insulative body and are arranged in one row. Because the mounting portions are arranged in one row, it is difficult to increase terminal number.

U.S. Pat. No. 6,726,499 discloses another type of electrical connector comprising an insulative body, a row of upper terminals and a row of lower terminals. The upper terminals and lower terminals are fixed to the opposite sides of the insulative body respectively so that the connector can retain more terminals to obtain high speed data transfer rates. U.S. Pat. No. 6,575,763 discloses an electrical connector assembly comprising an upper connector and a lower connector. The terminals of the upper connector and the lower connector attach solder balls thereon by Ball-Grid Array process and connect to the PCB (Printed Circuit Board). After the lower connector and the upper connector are fixed on the PCB, it is difficult to check if the terminals communicate with the PCB electrically because the jointing points of terminals and the PCB locate between the PCB and the insulative housing. Understandably, when these connectors of the above-mentioned patents are mounted to a PCB, the whole connectors are located above the PCB, which is undesirable in the circumstance where the heights of the components above the PCB are limited.

U.S. Pat. No. 6,764,338 discloses a mini DIN connector comprising an insulative housing and terminals. Each terminal has a mating portion received in a terminal passageway, a transitional portion extending upwardly from the rear end of the mating portion, a connect portion extending rearwardly from the top end of the transitional portion and a tail portion extending downwardly from the rear end of the connect portion. When the connector is mounted on the printed circuit board with an opening, two support portions in the lateral faces of the housing respectively stand on the upper surface of the printed circuit board beside the opposite sides of the opening, the free ends of the tail portions of the terminals are received and soldered in the plated holes of the printed circuit board. Thus the lower portion of the connector is located below the circuit board, thereby reducing the height of the connector above the printed circuit board. Obviously, this means is difficultly used to improve the connector of the above-mentioned U.S. Pat. No. 6,726,499, because the terminals is so dense that the safety space between the terminals are insured barely.

Therefore, it is desired to have an improved electrical connector to overcome the disadvantages of the prior art.

SUMMARY OF THE INVENTION

Accordingly, an object of the present invention is to provide an electrical connector having a reduced height above a PCB.

To achieve the above-mentioned object, the electrical connector comprising an insulative housing comprising a top wall, a bottom wall, and a mating slot opening forwardly and defined between said top and bottom walls, at least one piece of lower terminal comprising a mating portion received in said bottom wall and extending into said mating slot, a rising portion extending from the back-end of said mating portion upwardly, a main portion extending rearwardly from a top end of said rising portion and a mounting portion extending downwardly from the back-end of said main portion.

Other objects, advantages and novel features of the present invention will become more apparent from the following detailed description of the present embodiment when taken in conjunction with the accompanying drawings.

DETAILED DESCRIPTION OF THE PREFERRED EMBODIMENT

Figure 1:
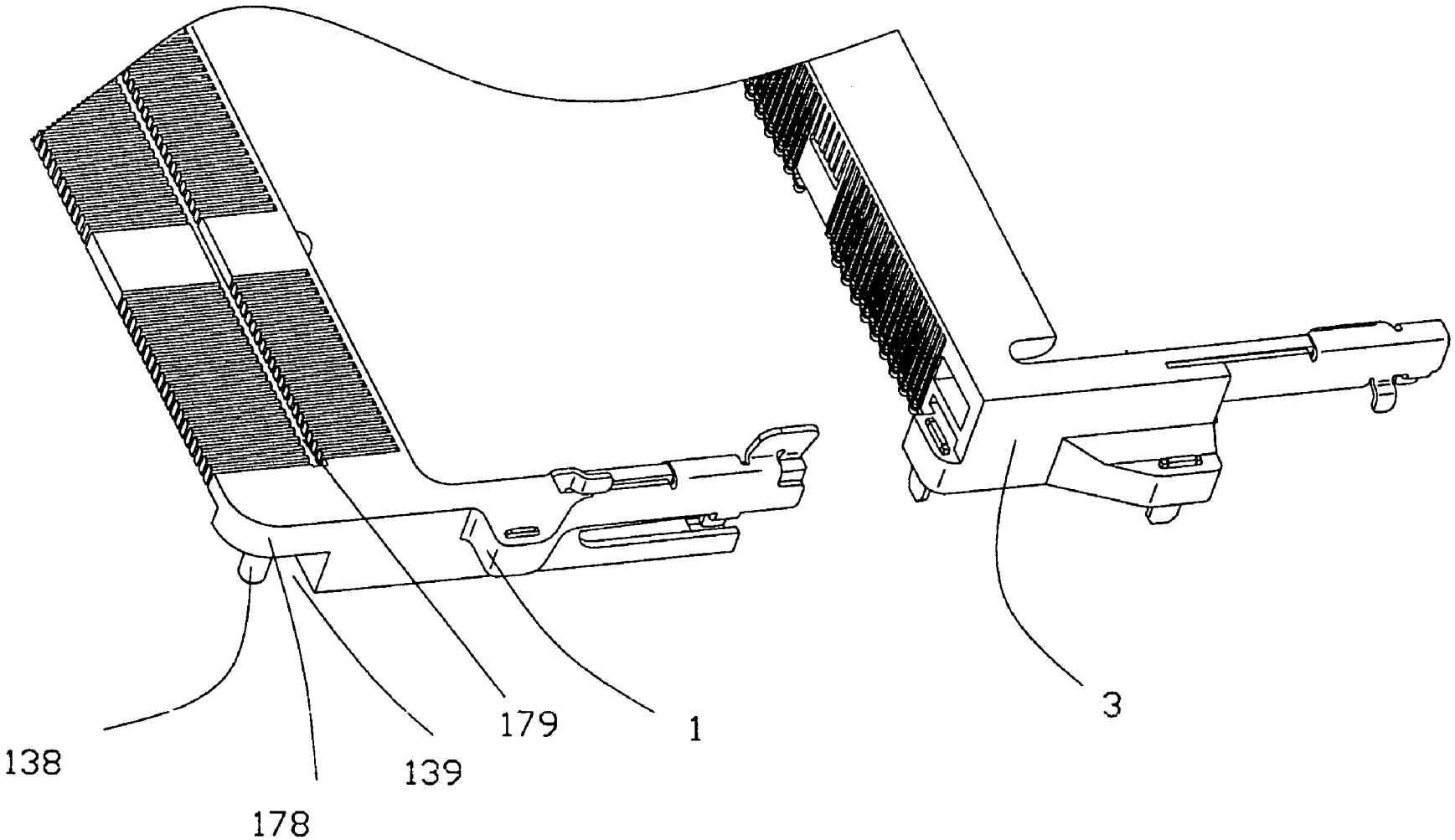
FIG. 1 is a partly perspective view of the first connector of an exemplary embodiment of the present invention and the corresponding second connector to be stacked thereon.

References will now be made to the drawing figures to describe the preferred embodiment of the present invention in detail.

Figure 11:
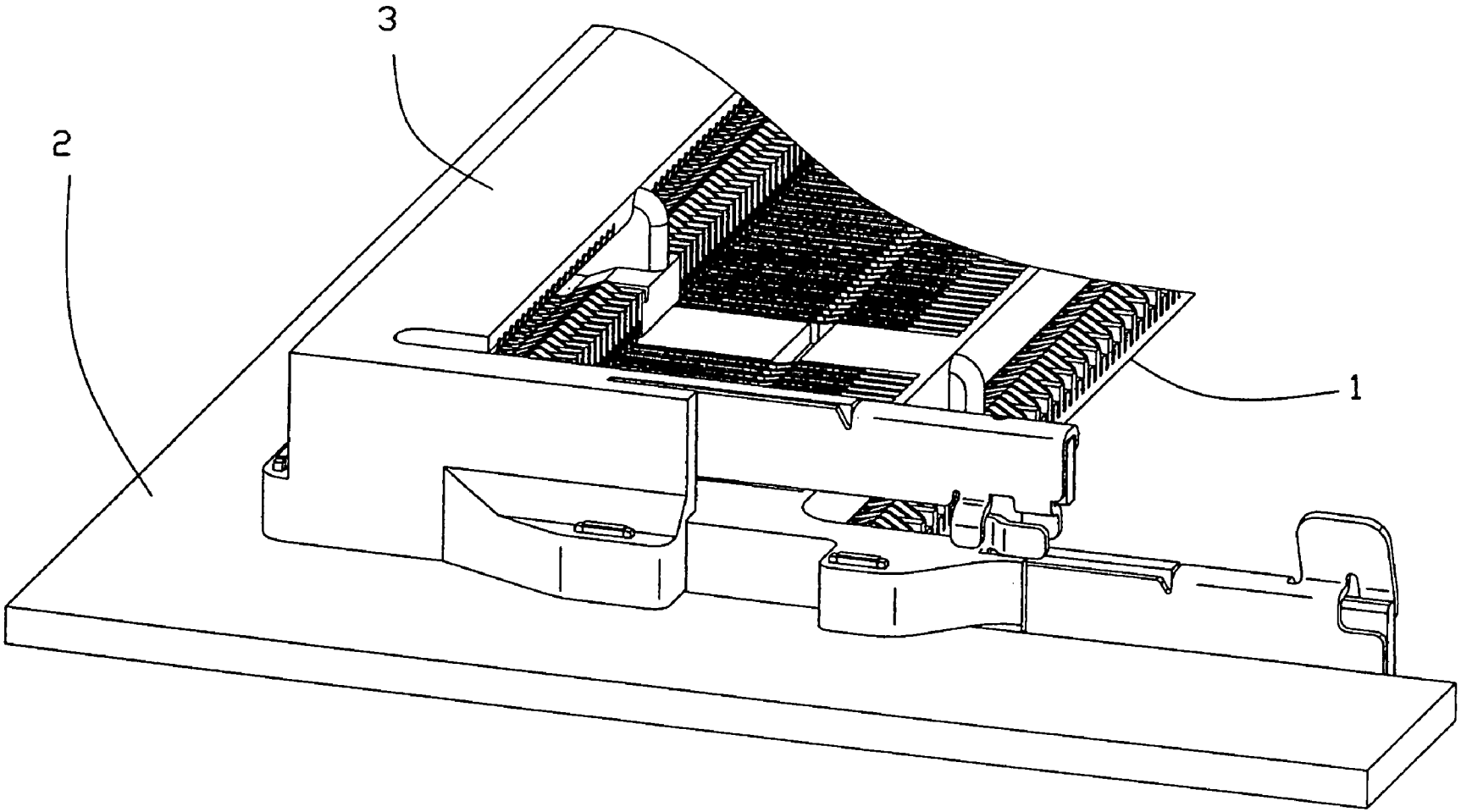
FIG. 11 is a perspective view of the first connector and the corresponding second connector stacking thereon both mounted upon a printed circuit board.
Figure 12:
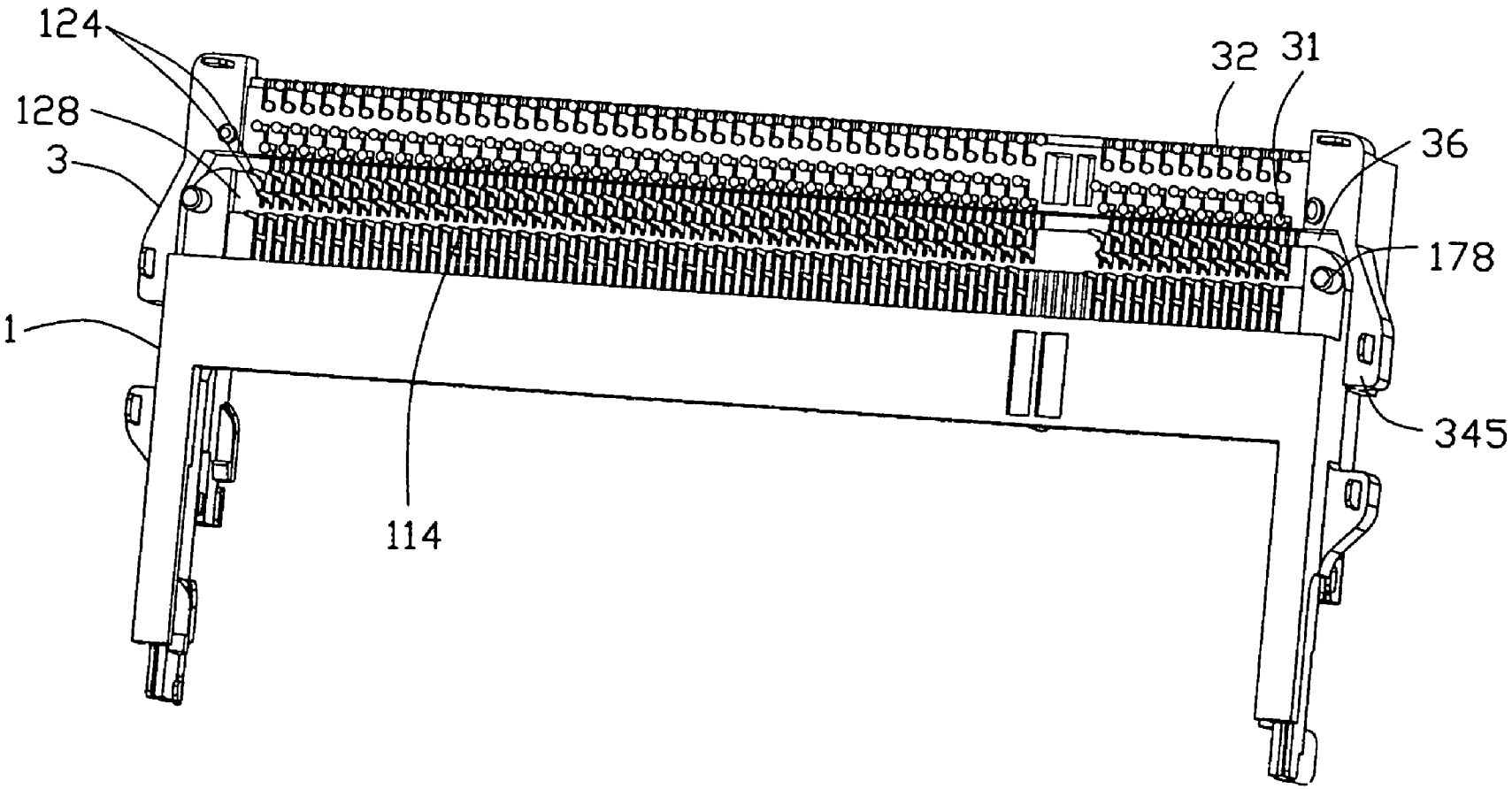
FIG. 12 is a perspective view of the first connector and the corresponding second connector stacking thereon taken from a different perspective.

It will be noted here that for a better understanding, most of like components are designated by like reference numerals throughout the various figures in the embodiments. Referring to FIG. 1 and FIG. 11, a first connector 1 and a second connector 3 are commonly mounted to a PCB (printed circuit board) 2 with an opening 21 at one side for holding a pair of electronic cards (not shown) on the printed circuit board 2, the second connector 3 is stacked on the first connector 1.

Referring to FIGS. 2A-4, the first connector 1 comprises insulative housing 10 and a plurality of first upper terminals 11 and first lower terminals 12 therein. The insulative housing 10 has an elongate first body 13 comprising a bottom wall 131, a top wall 132 opposite to the bottom wall 131 and a rear wall 134 connecting the bottom wall 131 and the top wall 132 together. The first body 13 defines a first mating slot 135 opening forward and surrounded by the bottom wall 131, the top wall 132 and the rear wall 134. The bottom wall 131 defines a plurality of lower terminal passageways 136 along and in communication with the mating slot 135, likely, the top wall 132 defines a plurality of upper terminal passageways 137 along and in communication with the mating slot 135. The upper terminal passageways 137 extend through the top wall 132 upwardly. When an electronic card is inserted into the mating slot 135, the mating components of the electronic card on the top and bottom faces connect electrically mating portions 111, 121 of the upper and lower terminals respectively. A pair of side walls 14 extending forwardly from the opposite ends of the first body 13 comprise end portions 141 connecting to the first body 13, upper spring arms 142 and lower retaining portions 143. Each free end of the spring arm 142 has a protrusion 144 and a latching portion 145 with guiding face for latching the electronic card to the first connector 1. A metallic arm 146 used to reinforce the spring arm 142 comprises a mounting portion 147 for inserting into a recess (not shown) in the insulative housing 10 and fixing the metallic arm 146 to the insulative housing 10, a guiding portion 148 coupling with and covering the latching portion 145, and an operating portion (not labeled). The operating portion has an operating piece 149 extending upwardly from the metallic arm 146 in an oblique manner and a slit piece 1491, wherein the slit piece 1491 couple with the spring arm 142. The slit piece 1491 drives the spring arm 142 to move when the operating piece is handled outward. The metallic arm 146 has a stopping portion 151 corresponding to a stopping groove 152 to prevent the spring arm 142 from destroying when the operating portion 149 is handled to release the electronic card.

Figure 4:
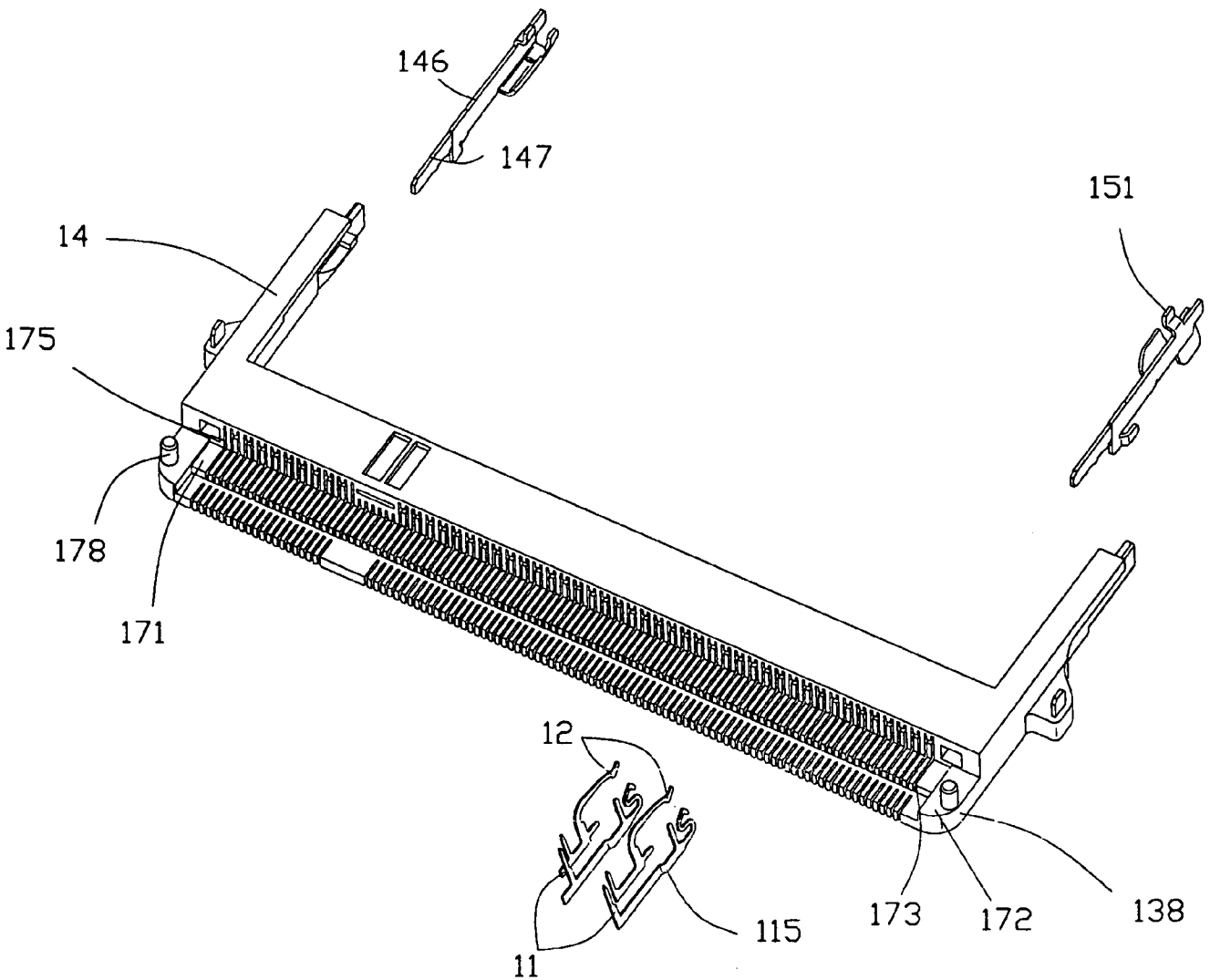
FIG. 4 is an exploded, perspective view of the first connector of FIG. 3.
Figure 5:
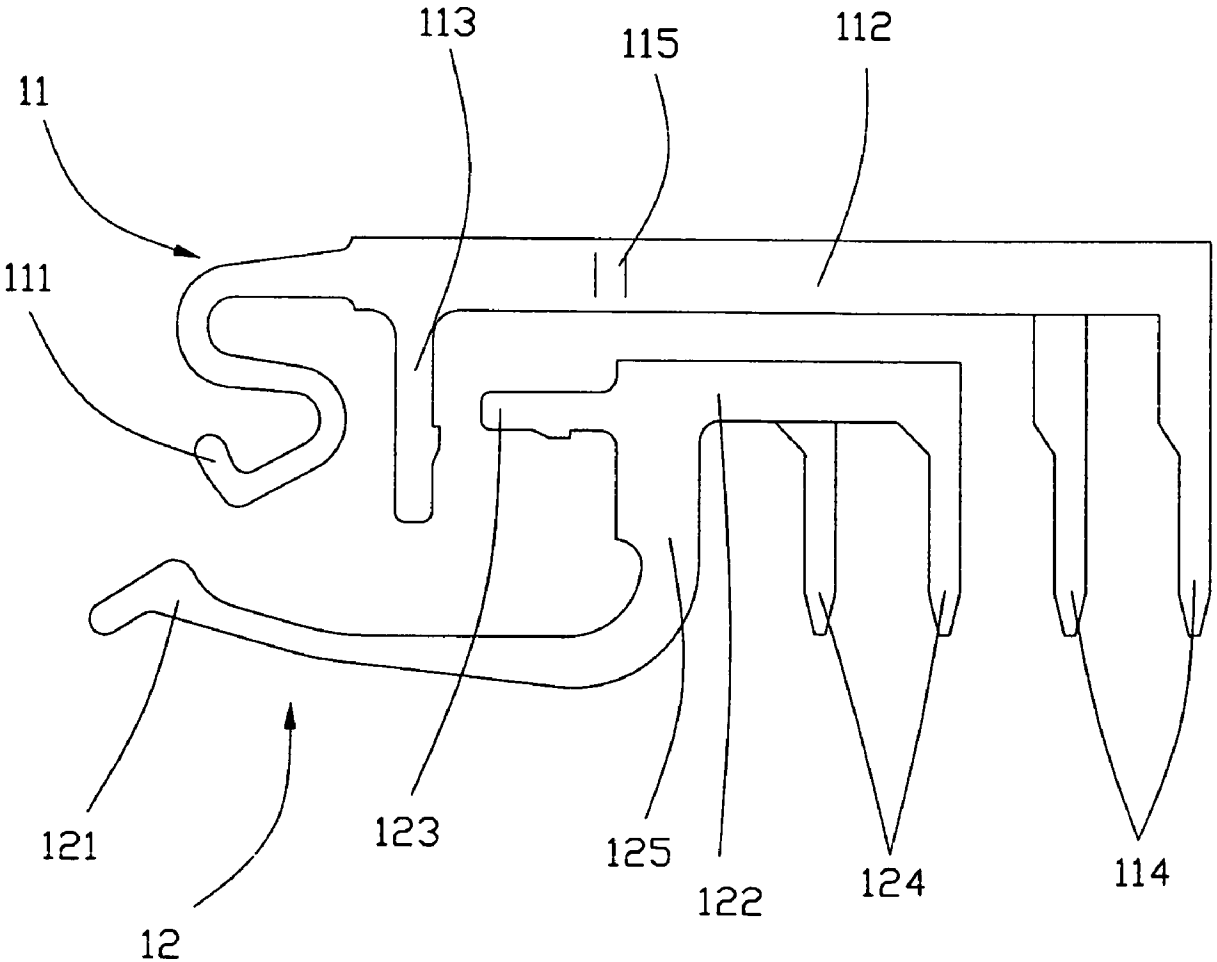
FIG. 5 is a right elevational view of the connector (only terminals is shown) of FIG. 2A.

Referring to FIGS. 4-5, each first lower terminal 12 has a main portion 122, a rising portion 125 extending downwardly from the front end of the main portion 122, said mating portion 121 extending forwardly and upwardly from the bottom end of the rising portion 122 in an oblique manner, a retaining portion 123 extending forwardly from the front end of main portion 122, a mounting portion 124 downwardly extending from the rear end of the main portion 122. Each first upper terminal 11 has a main portion 112, said mating portion 111 being "S" shaped and extending downwardly from the front end of the main portion 112, a retaining portion 113 extending downwardly from the front end of main portion 112, a mounting portion 114 extending downwardly from the rear end of the main portion 112.

Figure 3:
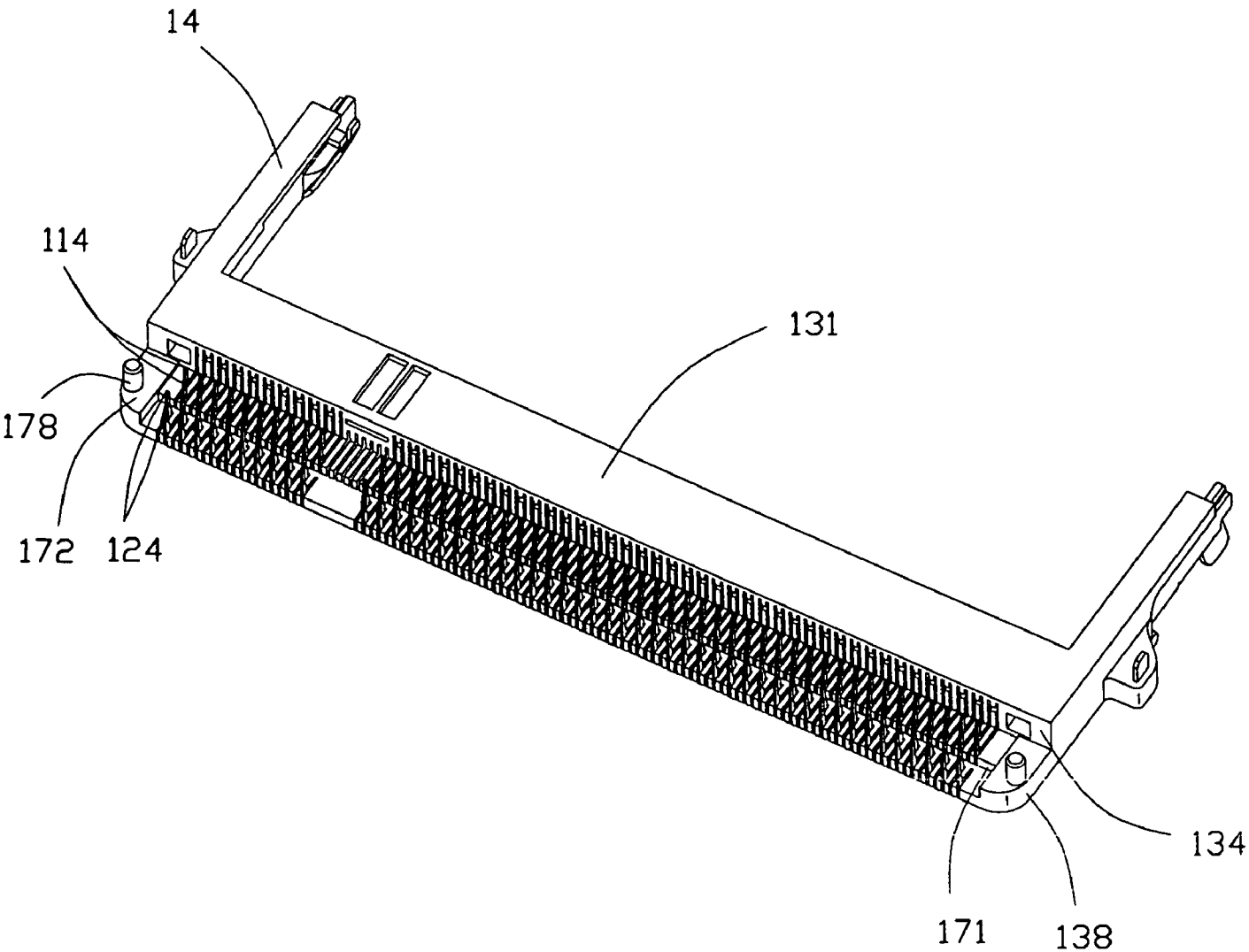
FIG. 3 is a view similar to FIG. 2A but taken from a different perspective.

Referring to FIG. 3, the top wall 132 of the first body 13 is formed with a flat roof 138 protruding out of the rear wall 134, which defines a room 139 above a plane of the bottom wall 131. The flat roof 138 comprises a flat retaining layer 171, a pair of supporting layer 172 protruding out of the flat retaining layer 171 and positioned at opposite ends of flat retaining layer 171. Each supporting layer 172 has a positioning post 178 protruding into the room 139, and the flat retaining layer 171 defines a lot of lower retaining groove 173. The supporting layers 172 stand on the PCB and a space (not labeled) is formed between the retaining layer 171 and the PCB, which avoids solder bridging effectively on the PCB in soldering.

Figure 7:
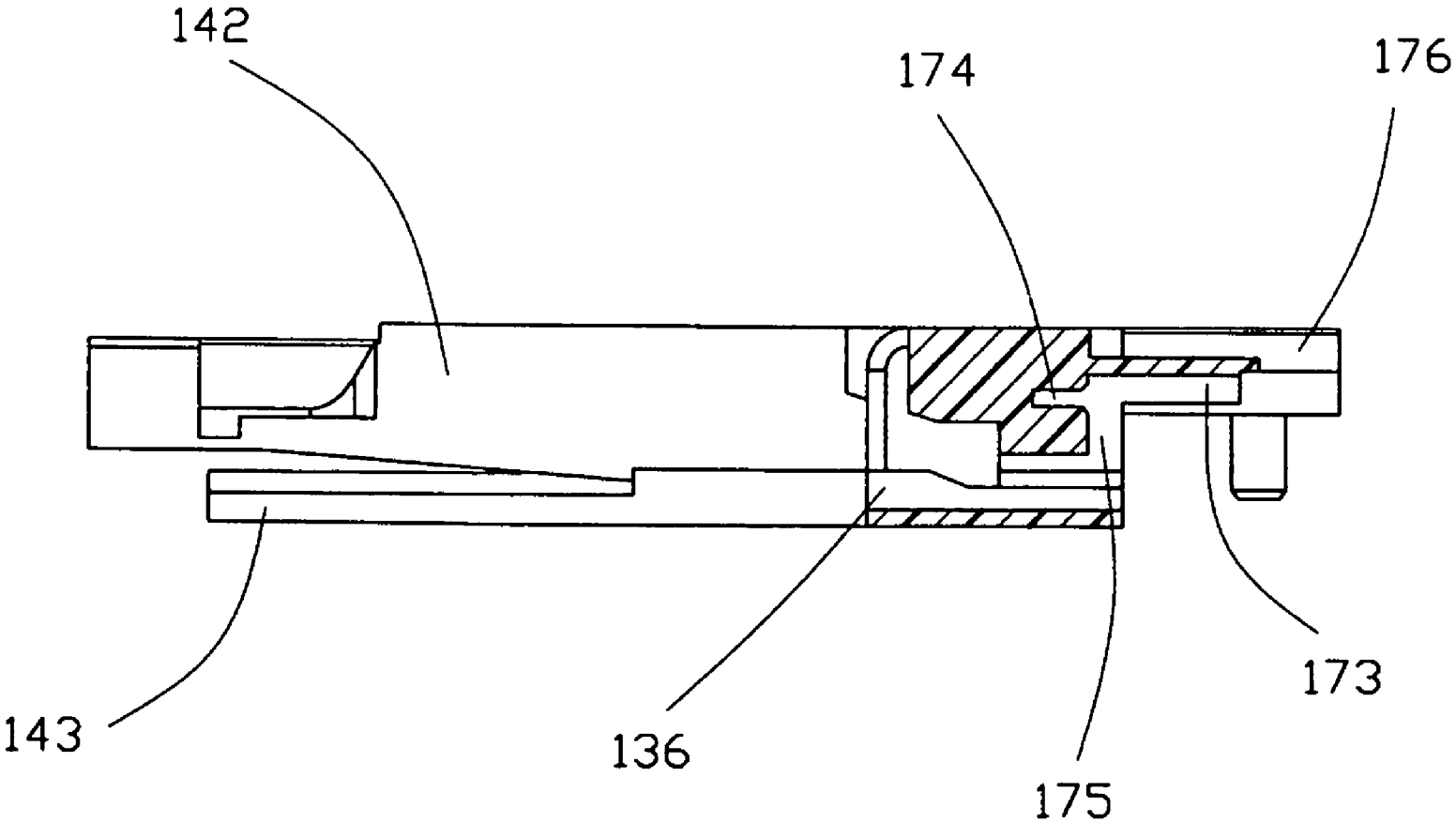
FIG. 7 is a cross-sectional view of FIG. 2B taken along line 7-7 while terminals are removed.
Figure 8:
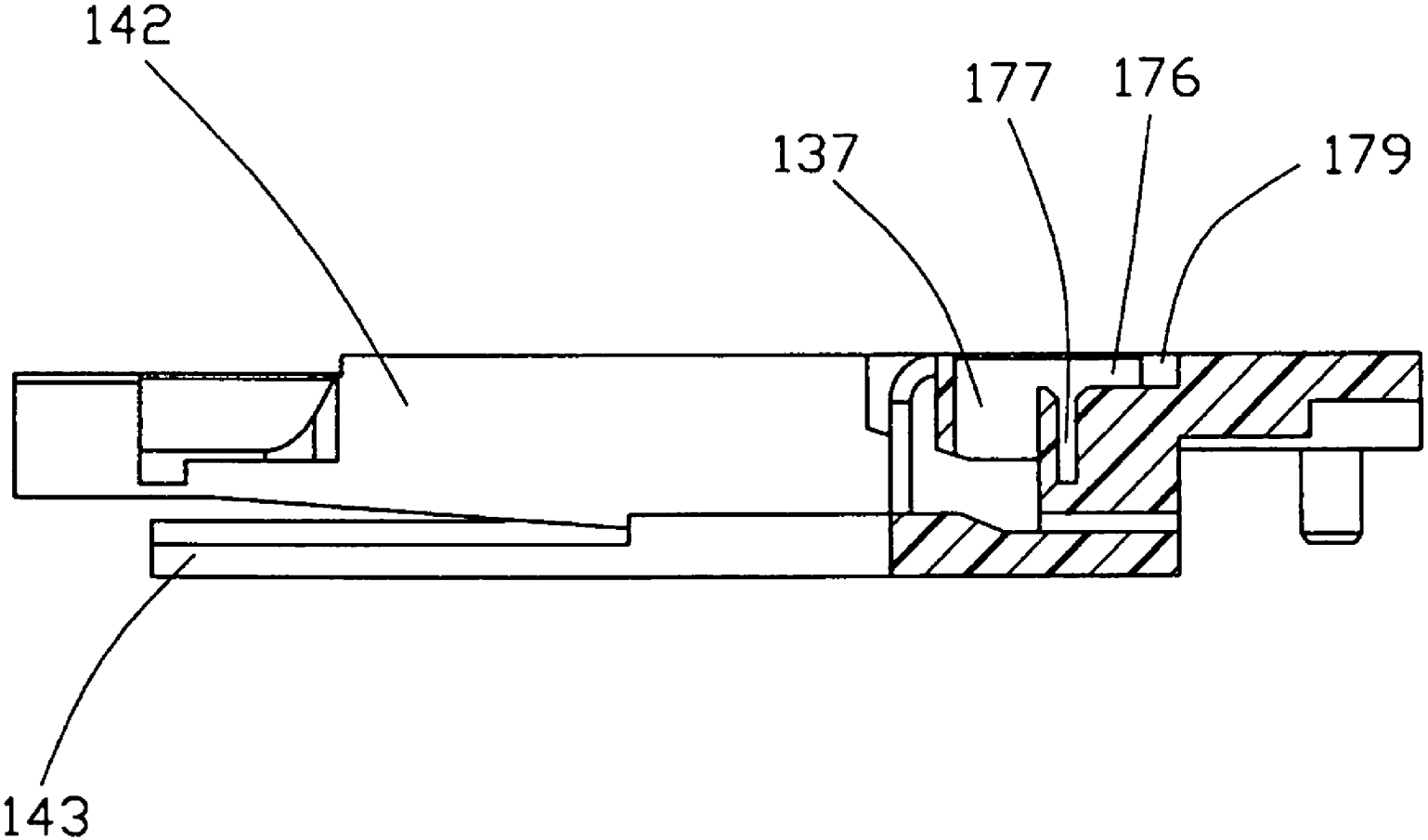
FIG. 8 is a cross-sectional view of FIG. 2B taken along line 8-8 with terminals are removed.

Referring to FIGS. 7-8, the first lower terminals 12 are assembled to the first connector 1 with the retaining portions 123 inserted into corresponding lower retaining recesses 174 of the insulative housing 10 from rear side of the first body 13, the main portions 122 retained in the lower retaining grooves 173, the mating portions 121 retained in the lower terminal passageways 136, and the mounting portions 124 protruding into the room 139. The rear wall 134 define a plurality of connecting grooves 175 which is open at the rear side thereof, and the connecting grooves 175 communicate the lower terminals passageways 136 and the lower retaining grooves 173. The lower terminal passageway 136, the lower retaining groove 173, the connecting groove 175 and the lower retaining recess 174 form a first lower terminal slot. The flat roof 138 defines a plurality of upper retaining grooves 176 opening at the top side and communicating with the upper terminal passageway 137, wherein the upper retaining grooves 176 extend through the flat roof 138 front-to-back and on the top wall 132. The first upper terminal 11 is assembled to the first connector 1 with the retaining portions 113 inserted into corresponding upper retaining recess 177 of the insulative housing 10 from upside of the first body 13, the main portion 112 retained in the upper retaining groove 176, the mating portions 111 retained in the upper terminal passageway 137, and the mounting portion 114 protruding into the room 139. The upper terminal passageway 137, the upper retaining groove 176, and the upper retaining recess 177 form a first upper terminal slot.

Figure 2A:
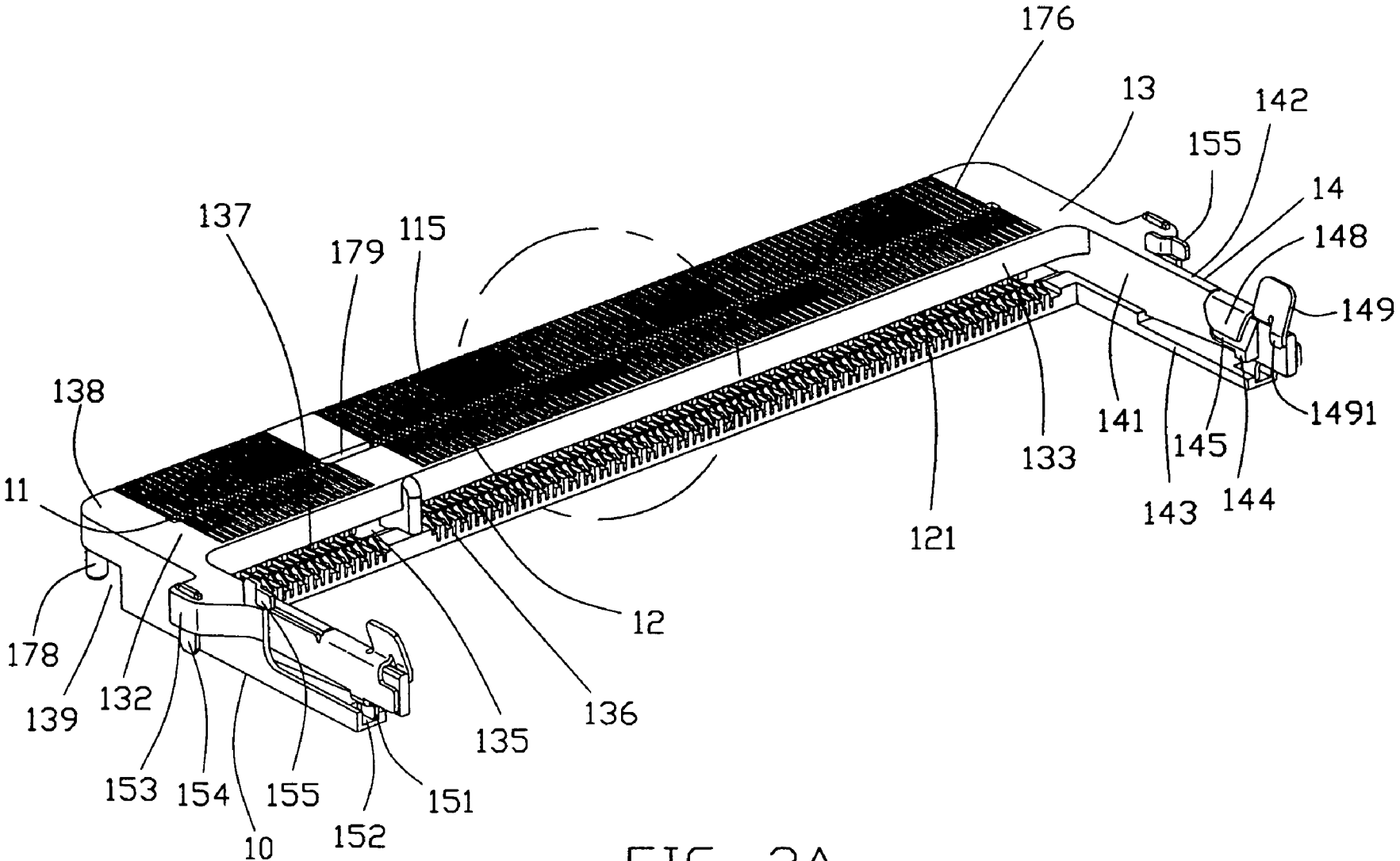
FIG. 2A is a perspective view of the first connector.
Figure 2B:
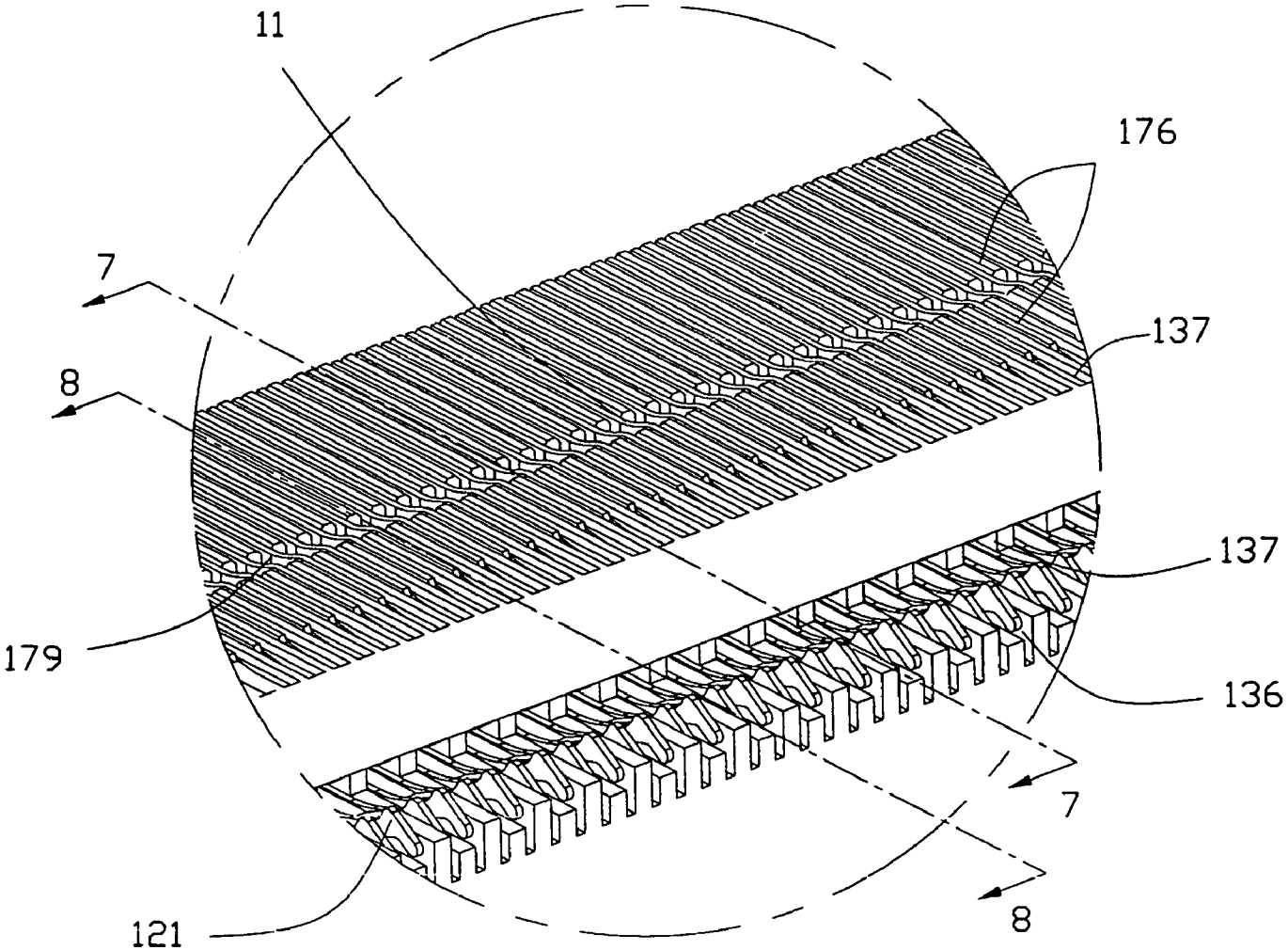
FIG. 2B is a partly enlarged perspective view in FIG. 2A.

Referring to FIG. 2B, the space between two neighbouring first lower terminals or upper terminals 12, 11 are so little that the partition (not labeled) between said two neighbouring first lower terminals or upper terminals 12, 11 is also little, and the space is less because of increasing terminals. Referring to FIG. 5, the first lower terminals and upper terminals 12, 11 have some structures located on the same height. After assembling the first lower terminals 12 to the insulative housing 10, the partition should define cutout for passing the first upper terminals 11 if the first upper terminals 11 are assembled to the housing 10 in front-to-back or back-to-front direction. Obviously, it is difficult to define cutout in the partition. The preferred embodiment of the present invention defines the upper terminal passageway 137 and the upper retaining groove 176 both opening at upside of the housing 10, so the first upper terminal 11 is assembled to the housing 10 in up-to-below direction, thus the first upper terminal 11 could use in the first connector 1 with high density terminals, and the insultive housing 10 is produced easy. There is an insulative film (not shown) covering on the top surface of the top wall 132 and the flat roof 138 to protect the first upper terminals 11 from dust and other components.

Figure 13:
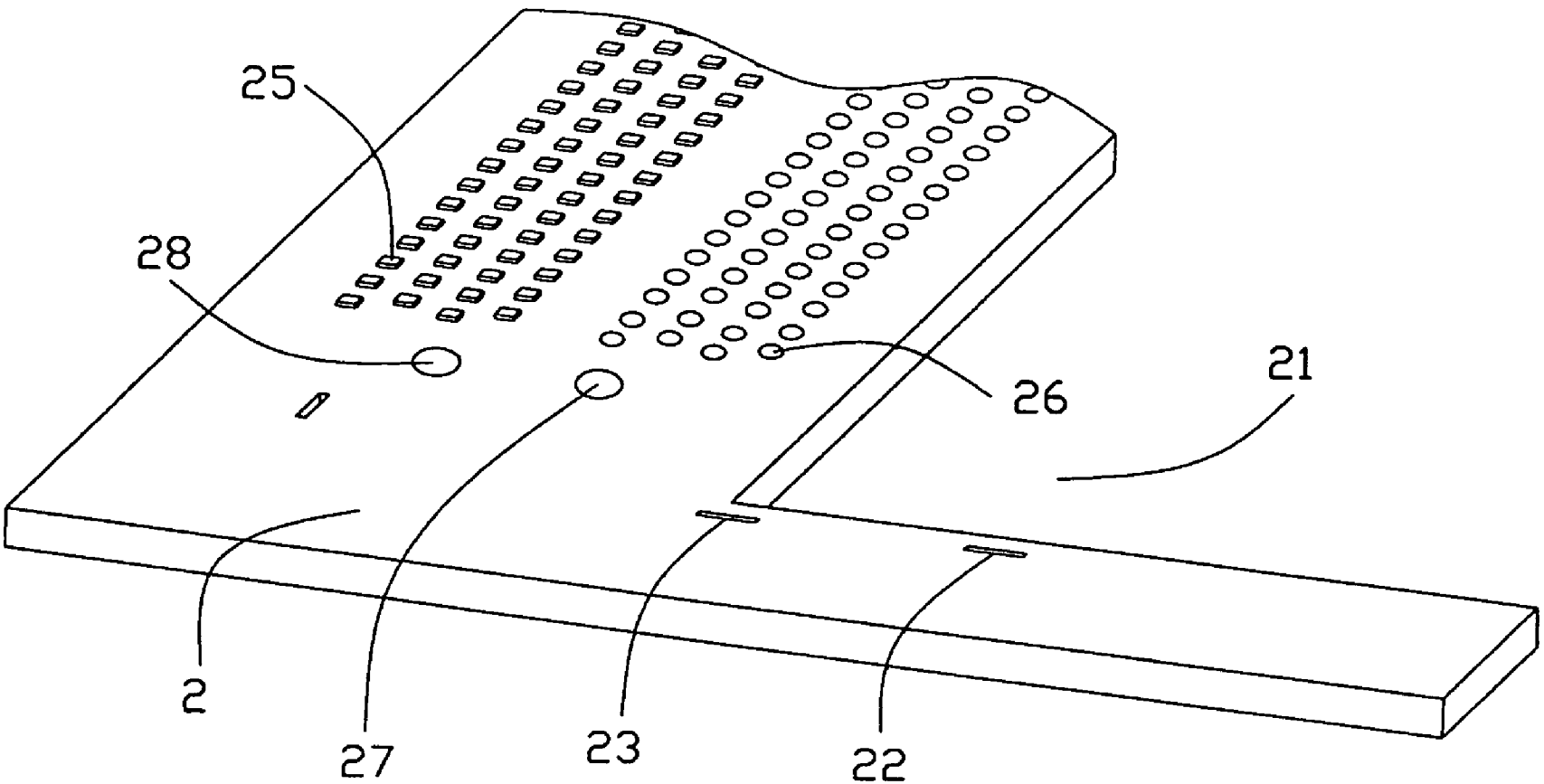
FIG. 13 is a partly perspective view of a printed circuit board of the first connector and the corresponding second connector to be fixed thereon.

Referring to FIGS. 1, 11 and 13, in assembly, the positioning post 178 inserts into a positioning hole 27, the flat roof 138 stands on the upper surface of the PCB, the mounting portions 114, 124 of the terminals 11, 12 are received and soldered in plated holes 26 of the PCB. Thus the bottom wall 131 of the first connector 1 is located below the PCB, thereby reducing the height of the first connector 1 above the PCB. For supporting the first connector 1, there is a pair of first stands 153 extending outward from the pair of side wall 14 of the insulative housing 10. The bottom face of the first stand 153 is located at the same level as the bottom face of the supporting layer 172, while at a higher level than the bottom face of the bottom wall 131, and the first stands 153 respectively stand on the upper surface of the PCB beside the opposite sides of the opening 21 for supporting the first connector 1. The first stand 153 have a metallic grasping portion 154 coupling with a corresponding positioning hole 22 to fix the first connector 1 on the PCB. The front end of the first stand 153 is positioned before the mating portions 111, 121, so the first stand 153 bear the force and prevent the electrical and mechanical connection between the first terminals 11,12 and the PCB from destroying when the electronic card is inserted into the mating slot 135 and latched by the spring arms 142. The metallic grasping portions 154 are inserted into and fixed in the stand 153 and mounted on the PCB coupling with the corresponding positioning holes 22 finally, it is to say, the connections between the metallic grasping portion 154 and the stand 153 and the PCB are assured, thus the position of the first connector 1 on the PCB is precise, thereby the first connector 1 would be fixed on the PCB stably.

Figure 6:
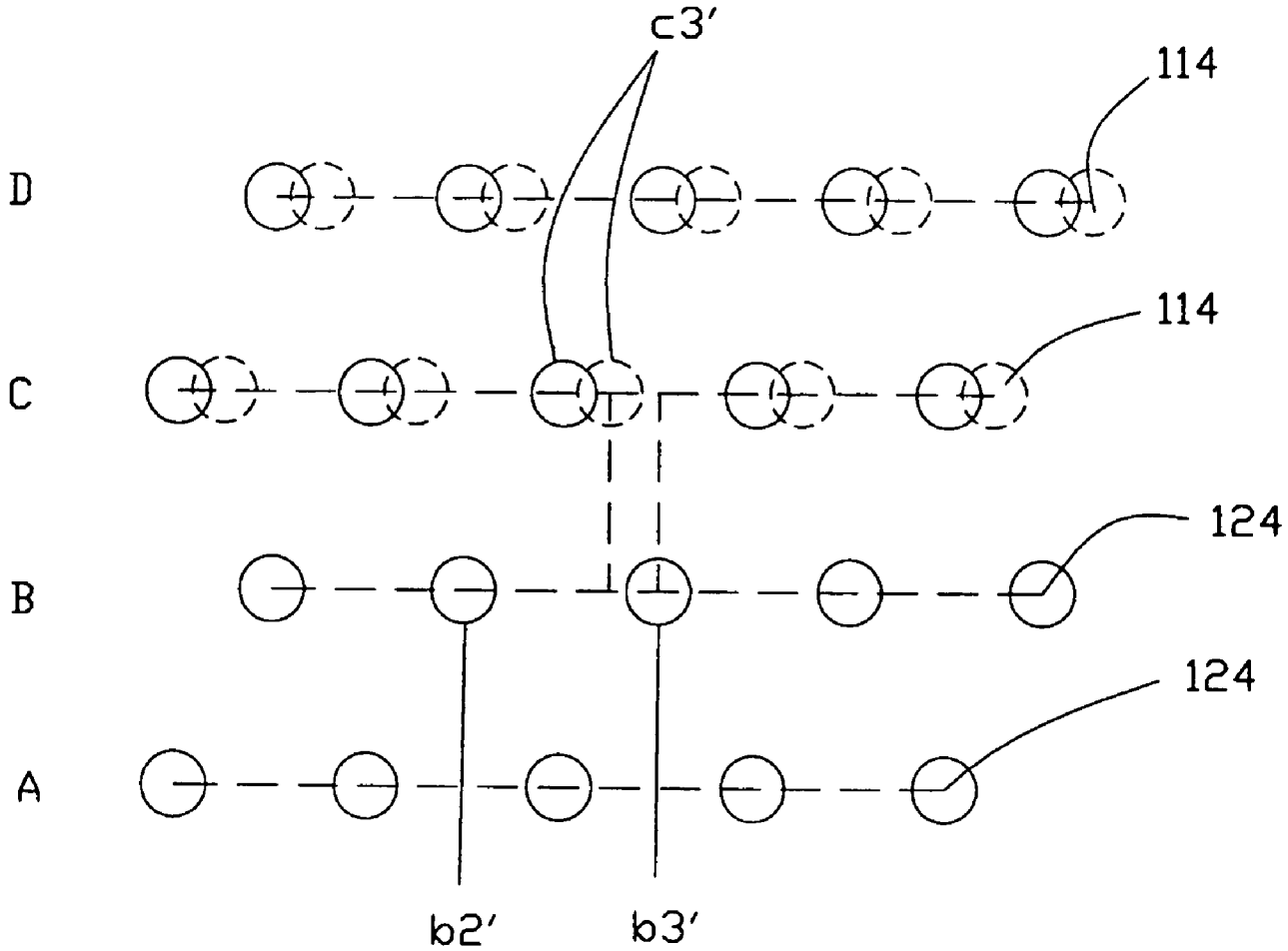
FIG. 6 is a exemplary view showing the position of the mounting portions of terminals of the connector.

For obtaining high speed data transfer rates, more terminals are retained in the connector, that is, the space between two neighboring terminals is less. Referring to FIGS. 3-5, the first upper terminals 11 and the first lower terminals 12 arrange in row, and the neighboring first upper terminals 11 are different in shape, detailedly, a first upper terminal 11 has a mounting portion 114 extending downwardly from the distal end thereof, while the neighboring first upper terminal 11 has a mounting portion 114 extending downward from a point of the main portion 112 which is apart from the distal end, thus the mounting portions 114 are arranged in two rows, thereby the space between two mounting portions 114 of two neighboring first upper terminals 11 is bigger than the space between two mating portions 111 of two neighboring first upper terminals 11. Likely, the mounting portions 124 of the first lower terminals are also arranged in two rows. That the space between two neighboring mounting portions is bigger than the space between two mating portions of two neighboring terminals avoids solder bridging effectively on the PCB. An electronic card has a row upper mating pads and a row lower mating pads. Corresponding upper and lower mating pad, such as a first one of the upper mating pad and a first one of the lower mating pad, offset with a distance (hereinafter offset-distance), usually 0.3 mm. Accordingly the mating portion 111, 121 of the first terminal 11, 12 offsets with a distance equal to the offset-distance. Referring to FIG. 6, the mounting portions 114 of the first upper terminals 11 are arranged in two lows which are labeled A, B, the mounting portions 124 of the first upper terminals 12 are arranged in two rows which are labeled C, D, so the space between two neighboring mounting portions is 4 times of the offset-distance in a row. The mounting portions 124 of conventional first lower terminals 12 are shown in broken-line, the space between the mounting portion c3' and the mounting portion b2' being 3 times of the offset-distance is not equal to the space between the mounting portion c3' and the mounting portion b3' being offset-distance, so the spaces of the plated holes 26 on the PCB are not uniform. In the preferred embodiment of the present invention, the first upper terminals 11 have bending portions 115 on the main portions 112 to obtain a offset equal to the offset-distance, the mounting portions 124 of the first lower terminals 12 are shown in solid-line, the space between the mounting portion c3' and the mounting portion b2' being 2 times of the offset-distance is equal to the space between the mounting portion c3' and the mounting portion b3' being 2 times of the offset-distance, so the spaces of the plated holes 26 on the PCB is uniform, thereby the PCB obtains an improved structure.

In order to house the bending portions 115, the upper retaining grooves 176 define a recess 179 which extends through all the upper retaining grooves 176 in left-to-right direction and divides all the upper retaining grooves 176 into two parts. The bending portions 115 form a plane which is perpendicular to the direction of the first upper terminals 11 insertion, so the bending portions would receive in the recess 179 completely and the height of the recess 179 is equal to the thickness of the bending portion 115.

Similarly, the rising portions 125 of the first lower terminals 12 have the same bending portions (not shown) also obtain uniform spaces of the plated holes 26 of the PCB and an improved structure of the PCB, if the first upper terminals 11 do not have bending portions 115. In order to house the bending portions of the rising portions 125, the connecting grooves 175 define a recess (not shown) which extends through all the connecting grooves 175 in left-to-right direction and divides all the connecting grooves 175 into two parts.

Figure 9:
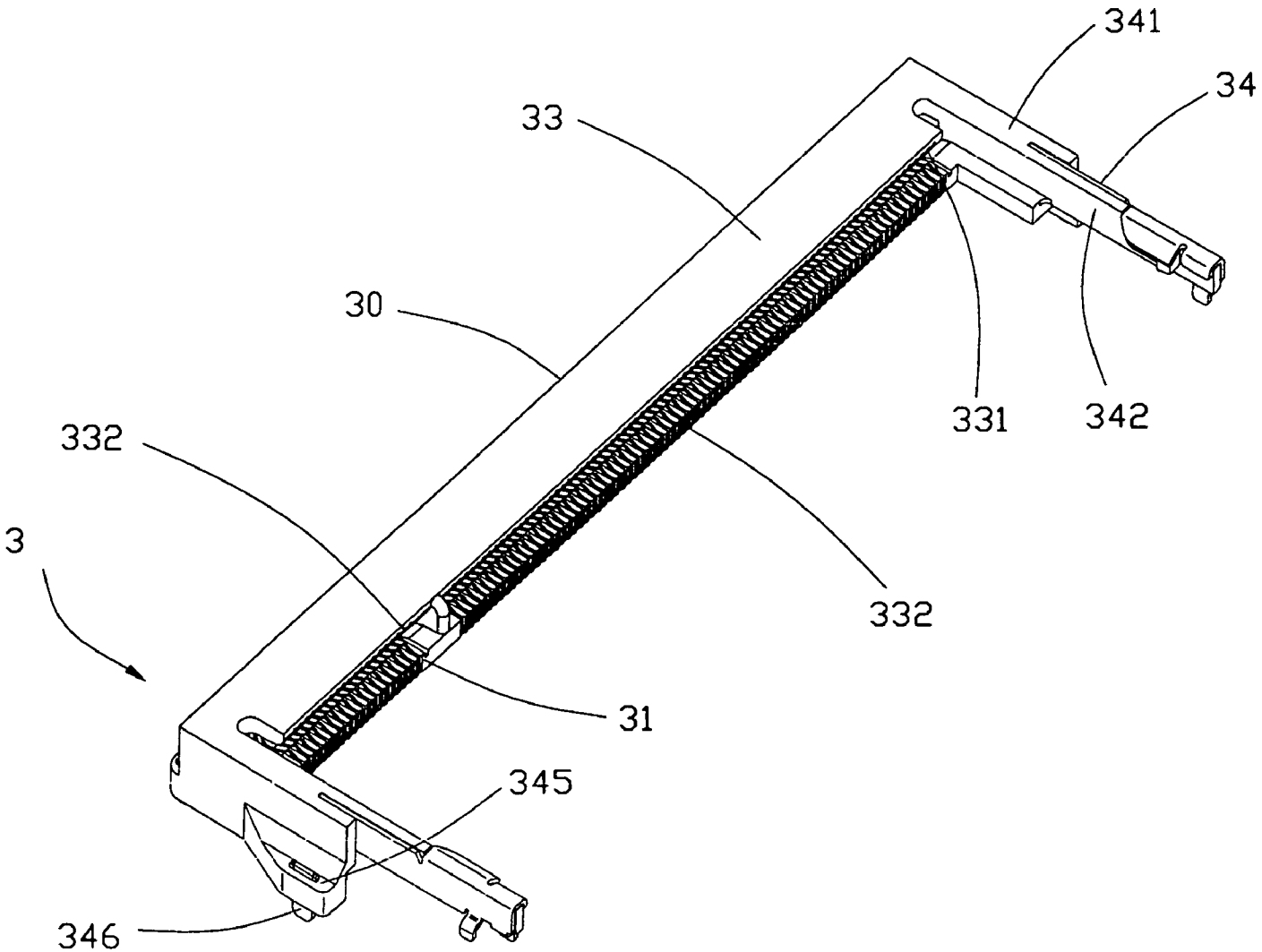
FIG. 9 is a perspective view of the second connector.
Figure 10:
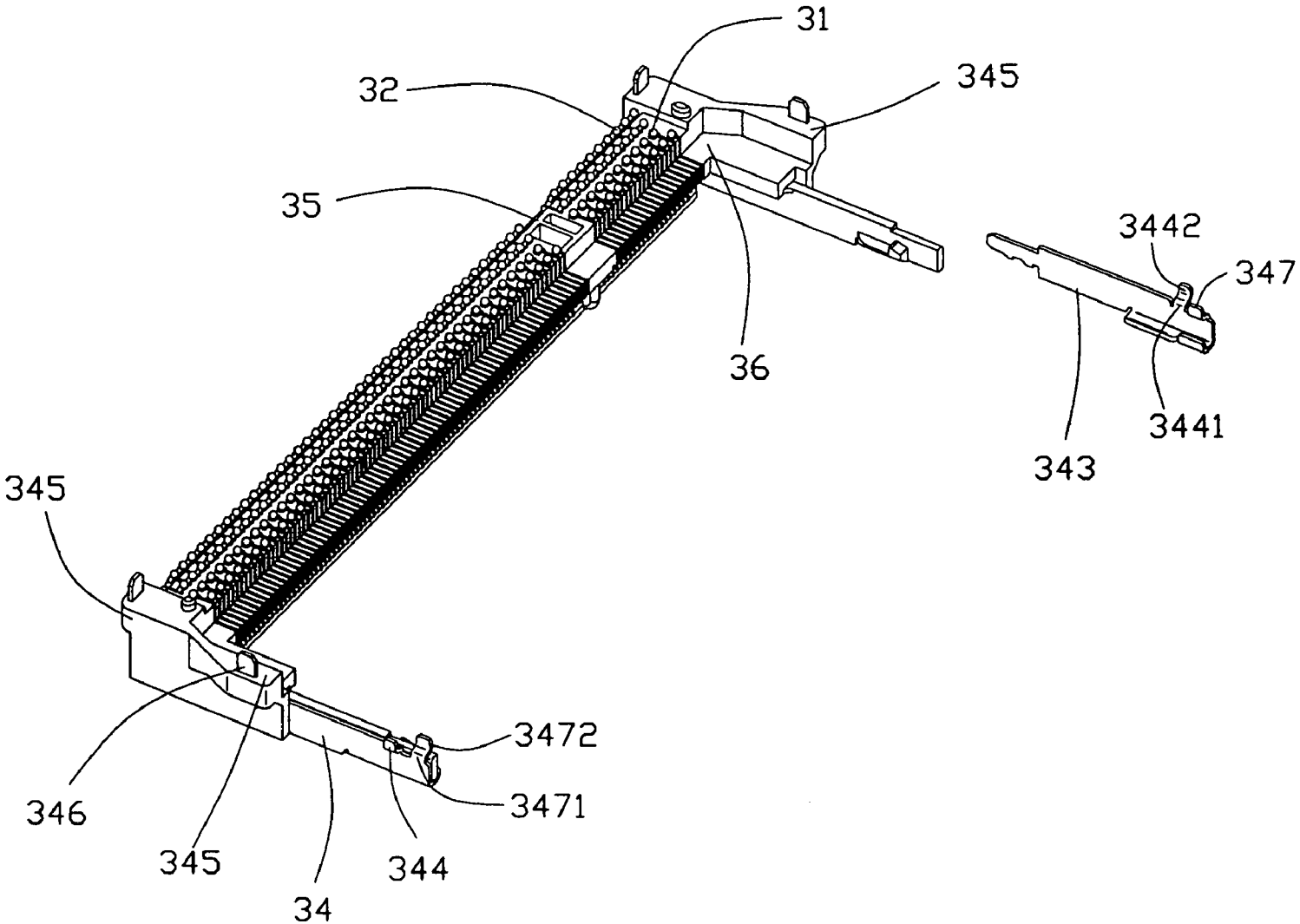
FIG. 10 is an exploded, perspective view of the connector taken from a different perspective of FIG. 9.

Referring to FIGS. 9-10, a second connector 3 stacking on the first connector 1 comprises an insulative housing 30 and a plurality of second lower and upper terminals 31, 32 therein, wherein the insulative housing 30 have a second elongated body 33, a pillow 35 extending downwardly from the second body 33 and a pair of latching arms 34 extending forwardly from the opposite ends thereof. There is a concave room 36 surrounded by the second body 33, latching arms 34 and pillow 35. The second body 33 have a second mating slot 331 for receiving an electronic card and two rows of terminal passageways 332 in communication with the second mating slot 331. The second lower and upper terminals 31, 32 are retained in the terminal passageways 332, and the mating portions (not labeled) of the second lower and upper terminals 31, 32 protrude into the second mating slot 331. Each latching arm 34 has an upper end portion 341, an upper arm 342, and upper metallic arm 343, wherein the upper metallic arm 343 extends downwardly and forms a first stopping piece 344 and a second stopping piece 347. The first stopping piece 344 has a first bending piece 3441 extending from the upper metallic arm 343 and a first upright piece 3442 extending downwardly from the bottom end of the first bending piece 3441. The second stopping piece 347 has a second bending piece 3471 extending from the upper metallic arm 343 and a second upright piece 3472 extending downwardly from the bottom end of the second bending piece 3471. There is a setting space between the first and second upright pieces 3442, 3472 in left-to-right direction. The metallic arm 146 of the first connector 1 extends upwardly and forms a positioning piece 155 corresponding to the first and second stopping pieces 344, 347. The positioning piece 155 is located between the first and second stopping pieces 344, 347 to prevent the upper arms 342 from bending to destroy.

Referring to FIGS. 1, 10-13, in assembly, the first connector 1 is essentially located in front of the second connector 3, positioning posts (not labeled) of the second connector 3 insert into positioning holes 28, the top surface of the concave room 36 rests on the flat roof 138 and the first body 13 of the first connector 1. For supporting the second connector 3, there is a pair of second stands 345 extending outward from the latching arms 34 of the insulative housing 30. The bottom face of the second stand 345 is located at a lower level than the bottom surface of the pillow 35, and the second stands 345 respectively stand on the upper surface of the PCB beside the opposite sides of the opening 21 for supporting the second connector 3. The second stand 345 have a second metallic grasping portion 346 coupling with a corresponding positioning hole 23 to fix the second connector 3 on the PCB. The front end of the second stand 345 is positioned ahead of the mating portions of the second terminals 31, 32, so the second stand 345 bear the force and prevent the electrical and mechanical connection between the second terminals 31,32 and the PCB from destroying when an electronic card is inserted into the second mating slot 331 and latched by the upper arms 342.

Referring to FIGS. 3, 10-12, the mounting portions 114, 124 of the first terminals 11, 12 of the first connector 1 are inserted into and soldered in plated holes 26 of the PCB, while each mounting portion (not labeled) of the second terminals 31, 32 of the second connector 3 attached a solder ball solders on plated pad 25 on the PCB, that is, the first connector 1 is attached to the PCB by means of TH (through hole), while the second connector 3 is attached to the PCB by means of BGA (Ball Grid Array). The first connector 1 is easy to check and re-weld, and the re-welding of the first connector 1 does not need removing the second connector 3.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, person of ordinary skill in this field are to understand that all such equivalent structures are to be included within the scope of the following claims.

We claim:

1. An electrical connector for connecting electrically an electronic card to a printed circuit board, the electrical connector comprising:

an insulative housing comprising a top wall, a bottom wall, and a mating slot opening forwardly and defined between said cop and bottom walls;

at least one piece of lower terminal comprising a mating portion received in said bottom wall and extending into said mating slot, a rising portion extending from the back-end of said mating portion upwardly, a main portion extending rearwardly from a top end of said rising portion and a mounting portion extending downwardly from the back-end of said main portion;

wherein said insulative housing comprises at least one stand extending sidewardly therefrom, the bottom face of said stand is located at a higher lever than the bottom face of the bottom wall.

2. The electrical connector as described in claim 1, wherein said at least one stand comprises a metallic grasping portion fixed therein.

3. The electrical connector as described in claim 1, wherein said at least one piece of lower terminal comprises a retaining portion extending forwardly from the front end of said main portion which retains in a corresponding retaining recess of the insulative housing.

4. The electrical connector as described in claim 1, wherein the front end of said at least one stand is positioned ahead of the mating portion of said at least one piece of lower terminal.

5. The electrical connector as described in claim 4, wherein said insulative housing comprises a pair of side walls extending forwardly from the opposite ends of said insulative housing, said at least one stand extends from said side wall.

6. The electrical connector as described in claim 1, wherein said insulative housing comprises a rear wall which connects said top and bottom wall together ax the rear side, a flat roof protrudes out of the rear wall from said top wall, and the bottom face of said flat roof is located at a higher level than the bottom face of the bottom wall.

7. The electrical connector as described in claim 6, wherein said flat roof defines at least one retaining groove opening at the bottom face thereof, said main portion of said at least one piece of lower terminal is fixed in the at least one retaining groove.

8. The electrical connector as described in claim 6, wherein said flat roof comprises a flat retaining layer, a pair of supporting layer protruding our of the fiat retaining layer and positioned at opposite ends of flat retaining layer.

9. An electrical connector for connecting electrically an electronic card to a printed circuit board, comprising:

an insulative housing comprising a top wall, a bottom wall, a rear wall, and a mating slot opening forwardly and defined between said top wall and said bottom wall, the top and bottom wall define a set of upper terminal slots and a set of lower terminal slots in communication with said mating slot;

a set of upper terminals and a set of lower terminals supported by said insulative housing, which comprise mating portions protruding into said mating slot;

said upper terminals comprising said mating portions, mounting portions and main portions interconnecting the mating and mounting portions together;

said set of upper terminal slots opening upwardly, said set of upper terminals inserting into said set of upper terminal slots in up-to-bottom direction;

wherein each of said set of upper terminals has a bending portion located between said mating and mounting portion, said mounting portion and said mating portion have a setting offset in arrangement direction of said set of upper terminals.

10. The electrical connector as described in claim 9, wherein said bending portion is disposed on said main portion.

11. The electrical connector as described in claim 10, wherein said bending portion is located in a plane which is perpendicular to the direction of the upper terminals insertion.

12. The electrical connector as described in claim 11, wherein said insulative housing comprising a recess disposed at the same side of said upper terminal slots, the recess extends along the direction of said upper terminal slots arrangement, said bending portion receives in the recess.

13. An electrical connector assembly for connecting electrically a pair of electronic cards to a printed circuit board, comprising:

a first connector comprising a first insulative housing and two rows of first terminals with first mounting portions therein;

a second connector comprising a second insulative housing and two rows of second terminals with second mounting portions therein; and a front row of second terminals and a rear row of first terminals being adjacent to each other;

wherein the mounting portions of said first terminals are pin adapted to be inserted into corresponding plated boles of the printed circuit board, the mounting portions of said second terminals have solder tails and connecting with corresponding plated pads on the printed circuit board.

14. The electrical connector assembly as described in claim 13, wherein said printed circuit board defines an opening, the first housing, which directly contacts the printed circuit board, includes an elongated first body having the first terminals therein, and a pair of first side walls extending forwardly from two opposite ends of the first body each with a deflectable arm equipped with a latching portion, under a condition that most portions of the first housing including the first body and the pair of first side walls are located and confined within the opening and partially horizontally overlapped with the printed circuit board so as to reduce a height of the first connector above the printed circuit board and thus consequently lower a relative height of the second connector above the printed circuit board.

15. The electrical connector assembly as described in claim 13, wherein said second connector is stacked on said first connector, the first connector is essentially located in front of the second connector, a concave room being formed in a front lower portion of the housing of the second connector to compliantly receive a rear portion of the housing of the first connector.

16. The electrical connector assembly as described in claim 15, wherein said first connector comprises a pair of spring arms extending from the opposite ends thereof and a pair of metallic arm coupling with said spring arms, said metallic arm has an operating piece extending upwardly therefrom and a slit piece coupling with said spring arm and driving the spring arm to move.

17. The electrical connector assembly as described in claim 15, wherein said first and second connector both comprise a pair of first and second spring arms extending from the opposite ends of the first and second housings, a pair of first and second metallic arms coupling with said first and second spring arms, said second metallic arm has a first bending piece extending therefrom and a first upright piece extending from the first bending piece, a second bending piece extending therefrom and a second upright piece extending from the second bending piece, the first metallic arm has a positioning piece, said positioning piece is located between the first and second stopping pieces to prevent the second spring arm from bending to destroy.

18. An electrical connector assembly for connecting electrically a pair of electronic cards to a printed circuit board, comprising:

a first connector comprising a first Insulative housing and two rows of first terminals with first mounting portions therein;

a second connector comprising a second insulative housing and two rows of second terminals with second mounting portions therein; and a front row of second terminals and a rear row of first terminals being adjacent to each other, wherein said printed circuit board defines an opening, the first housing, which directly contacts the printed circuit board, includes an elongated first body having the first terminals therein, and a pair of first side walls extending forwardly from two opposite ends of the first body each with a deflectable arm equipped with a latching portion, under a condition that most portions of the first housing including the first body and the pair of first side walls are located and confined within the opening and partially horizontally overlapped with the printed circuit board so as to reduce a height of the first connector above the printed circuit board and thus consequently lower a relative height of the second connector above the printed circuit board.

* * * * *